US006983631B2

(12) United States Patent
Seidel

(10) Patent No.: US 6,983,631 B2
(45) Date of Patent: Jan. 10, 2006

(54) METHOD FOR OPERATING A MILL TRAIN AND A CORRESPONDINGLY EMBODIED MILL TRAIN

(75) Inventor: Jürgen Seidel, Kreuztal (DE)

(73) Assignee: SMS Demag AG, Düsseldorf (DE)

( * ) Notice: Subject to any disclaimer, the term of this patent is extended or adjusted under 35 U.S.C. 154(b) by 115 days.

(21) Appl. No.: 10/469,636

(22) PCT Filed: Feb. 28, 2002

(86) PCT No.: PCT/EP02/02131

§ 371 (c)(1),
(2), (4) Date: Sep. 3, 2003

(87) PCT Pub. No.: WO02/078872

PCT Pub. Date: Oct. 10, 2002

(65) Prior Publication Data

US 2004/0079127 A1 Apr. 29, 2004

(30) Foreign Application Priority Data

Mar. 31, 2001 (DE) ..... 101 16 273

(51) Int. Cl.
*B21B 37/68* (2006.01)

(52) U.S. Cl. ..... 72/7.6; 72/9.1; 72/11.7; 72/234

(58) Field of Classification Search ..... 72/7.5, 72/7.6, 8.5, 8.8, 9.1, 9.2, 11.3, 11.5, 11.7, 72/11.8, 12.2, 12.5, 234, 237; 700/149, 143, 700/154, 155

See application file for complete search history.

(56) References Cited

U.S. PATENT DOCUMENTS 4,063,076 A * 12/1977 Morooka et al. ..... 700/153

(Continued)

FOREIGN PATENT DOCUMENTS

DE 3516728 * 11/1985

(Continued)

OTHER PUBLICATIONS

Patent Abstract of Japan, vol. 12, No. 454 (M-769), Nov. 29, 1988 & JP 63 183713 A (Ishikawajima Harima Heavy IND CO LTD), Jul. 29, 1988.

(Continued)

*Primary Examiner*—Ed Tolan
(74) *Attorney, Agent, or Firm*—Friedrich Kueffner

(57) ABSTRACT

The invention relates to a mill train (1) for milling a strip-type product to be milled (10). Said mill train comprises a number of roll stands (2) which are successively arranged in a milling direction (x) and which can be respectively pivoted about a rotational axis (18) which is essentially perpendicular to the milling direction (x). The aim of the invention is to maintain a belt run which favors a pre-determined milling result, in an especially simple and reliable manner. According to the invention, a control value (S) is pre-determined for the pivoting angle of a roll stand, or of each roll stand (2), according to the determined contour of the strip end (30) of a product (10) which has already been milled. According to the invention, additional control elements can also be used.

10 Claims, 2 Drawing Sheets

U.S. PATENT DOCUMENTS

| | | | | | |
|---|---|---|---|---|---|
| 4,346,575 | A | * | 8/1982 | Shibahara et al. | 72/12.7 |
| 4,672,830 | A | * | 6/1987 | Tsukamoto et al. | 72/9.3 |
| 5,651,281 | A | * | 7/1997 | Seidel | 72/11.8 |
| 6,158,260 | A | * | 12/2000 | Ginzburg | 72/9.1 |

FOREIGN PATENT DOCUMENTS

| | | | |
|---|---|---|---|
| DE | 196 44 132 A1 | | 4/1998 |
| DE | 197 44 504 A1 | | 4/1999 |
| JP | 1-205819 | * | 8/1989 |
| JP | 6-292915 | * | 10/1994 |

OTHER PUBLICATIONS

Degner M et al: "Untersuchungen Zur Geometrischen Toleranzeinhaltung . . . ", Stahl und Eisen, BD, 116, No. 8, Aug. 19, 1996, pp. 113-118, 164.

* cited by examiner

METHOD FOR OPERATING A MILL TRAIN AND A CORRESPONDINGLY EMBODIED MILL TRAIN

This application is a national phase application of international application PCT/EP02/02131, filed Feb. 28, 2002.

BACKGROUND OF THE INVENTION

1. Field of the Invention

The invention concerns a method of operating a mill train for rolling strip-like rolling stock with an edger and a number of roll stands arranged one behind the other in a rolling direction, each of which has an adjusting unit for affecting the contour of the strip trailing end of rolling stock. The invention also concerns a mill train of this type, which, in particular, is also provided with an edger at the run-in end for width reduction of the rolling stock.

2. Description of the Related Art

A number of roll stands can be used in a mill train for rolling a rolling stock. The roll stands, which are usually designed as so-called multiple roll stands and comprise a number of work rolls and, if necessary, a number of backup rolls, are provided for passing through a usually very elongated rolling stock and are arranged one behind the other in the direction of advance of the rolling stock, which is also known as the rolling direction. A mill train with several roll stands of this type can be used especially in the working of a strip-like rolling stock or rolling strip. The strip-like rolling stock is formed in this case in the manner of a chiefly two-dimensional shape as rolling stock that is extended in a broad plane with a very small thickness relative to its dimensions in the extended plane.

Precisely in the working of rolling stock formed with this type of strip-like shape, the so-called strip flow, i.e., the passage of the rolling stock through the roll stands, is especially important. Specifically, during the working of the strip-like rolling stock, a tension develops within the rolling stock, which is also called strip tension. In this regard, the strip tension usually has a stabilizing effect on the actual strip flow. However, during working that is asymmetric with respect to the longitudinal central axis of the strip, the strip tension can also develop eccentrically. Consequently, deflection of the strip to the side may occur, for example, as the strip emerges from the rear roll stand as viewed in the rolling direction. Moreover, in the case of forces acting eccentrically on the rolling stock due to the strip tension, behavior of the strip trailing end that differs from that of the actual rolling stock can develop, which in turn can lead to rolling defects.

To be able to suitably control the strip flow, which is thus relevant to the rolling result, or the passage of the strip-like rolling stock through the roll stands, the roll stands can be designed in such a way that each roll stand is able to swivel about an axis of rotation that is essentially perpendicular to the rolling direction. By suitable swiveling of one or each roll stand, the strip flow can be affected in such a way that asymmetrically developing tensile stresses can be kept especially low, or in such a way that some other preset condition for the strip flow is maintained. Errors in the strip flow, which can result, for example, in defectively rolled strip trailing ends and damage to the rolls, which in turn can require additional roll changes, are usually corrected by suitable swiveling of the roll stands by an attendant. However, possible interventions with respect to achieving an especially good rolling result are limited, since, especially in the front roll stands as viewed in the rolling direction, necessary corrective measures are difficult to determine due to the still comparatively thick rolling stock present there, and since, in addition, the intervals between adjacent roll stands as viewed in the rolling direction are also comparatively difficult to inspect.

SUMMARY OF THE INVENTION

Therefore, the objective of the invention is to specify a method of operating a mill train of the type described above, with which a strip flow that is favorable for a predetermined rolling result can be reproducibly maintained in an especially simple and reliable way. The goal is to produce a symmetrical strip trailing end/leading end that is as rectangular as possible. Long slivers and fishtails at the strip trailing end are also to be avoided. An additional objective of the invention is to specify a mill train that is especially suitable for carrying out the method of the invention.

In accordance with the invention, the objective with respect to the method is achieved by predetermining a control value for an adjusting unit or for each adjusting unit assigned to a roll stand or an edger as a function of the contour determined for the strip trailing end of rolling stock that has already been rolled.

In this regard, the invention proceeds from the consideration that, to maintain a predetermined strip flow in a simple and reliable way, the strip flow should be affected on the basis of input variables that are especially characteristic for the strip flow of preceding rolling operations. In this way, the readjustment of the action taken to influence the strip flow can be made on the basis of preceding rolling results in the manner of a learning, self-adapting system. In this regard, the material flow in a rolled product that has already been produced is provided as the basis for the evaluation of the preceding rolling results, for this material flow occurs precisely as a function of the amount of swiveling of the roll stand that has been carried out for each rolled product. This material flow is reflected in the form of a cumulative effect over the entire length of the rolled product, especially in the region of the trailing end of the strip. An evaluation of the contour of the strip trailing end in the extended plane of the strip-like rolling stock thus yields especially valuable information for presetting the control values for the roll stands or the edger during the passage of the next rolling stock.

Advantageously, a control value for the swivel angle of one or each roll stand is preset as a function of the contour of the strip trailing end of the product that has already been rolled. Specifically, a suitable swivel value of the roll stand about its particular axis of rotation makes it possible to have an especially systemic effect on the strip flow.

The information obtained by evaluation of the contour of the strip trailing end is advantageously further used for additional corrective interventions in the current rolling process. In this regard, it is especially advantageous to calculate the behavior of the strip width in the successive stands, taking the strip elongation into consideration. On the basis of the information that is then available about the behavior of the strip width and on the basis of knowledge of the roll bending behavior, it is possible to prepare corrective values for the control value that is characteristic for the work roll bending in one or each subsequent roll stand. By means of these corrective values, the control values for the given work roll bending can be preset in such a way that surface unevenness and/or strip rolling defects occur only to an especially small extent.

Alternatively or additionally, the information obtained by the evaluation of the contour of the strip trailing end is advantageously used in the operation of a so-called looper. At constant tensile force, locally higher tensile stress can develop, e.g., in the case of narrowing width of the rolling stock in the region of its trailing end, and this can have the undesired consequence of the strip breaking. When the minimum width actually present is known on the basis of the evaluation of the contour of the strip trailing end, the tensile force acting on the particular looper can be appropriately reduced, as necessary, so that this type of break can be prevented. On the other hand, to avoid long strip slivers at the trailing end of the strip, a separate adjusting unit can be assigned to the edger, by which, for example, long strip slivers can be compensated by greater width reductions at the trailing end of the strip.

If an edger is used to control the width of the rolling stock, so-called fishtail ends can form at the trailing end of the strip, especially in the case of relatively large width reductions. These fishtail ends are disadvantageous as the strip runs out in the rear stands and can result in defective rolling. Furthermore, alternatively or additionally, the evaluation of the contour of the strip trailing end allows early detection of the formation of these types of fishtail ends, so that appropriate countermeasures can be taken, especially corrective interventions in the edger. On the other hand, to avoid long strip slivers at the trailing end of the strip, the edger is provided as a final control element. Long strip slivers can be controlled by greater width reductions at the absolute strip trailing end.

As an alternative or additional corrective intervention for the shape of the strip trailing end, the crown of the rolling stock can be influenced. For this purpose, crown final control elements, especially in the front roll stands as viewed in the rolling direction, can be provided with control values, which are also predetermined as a function of the contour determined for the strip trailing end. This is based on the recognition that elevation of the crown lengthens the edges of the strip, whereas lowering the crown lengthens the center of the strip. Suitable action to affect the crown thus indirectly affects the contour of the strip trailing end.

The contour of the strip trailing end of the product that has already been rolled can be determined at a suitable location within the mill train and by suitable means, for example, by a number of width sensors. Preferably, however, noncontacting, especially optical, determination of the contour of the trailing end of the strip is provided, and, in an advantageous embodiment, a camera can be used. In this regard, the contour of the strip trailing end can be evaluated by determining the position of the maximum in the contour in the width direction of the strip-like rolling stock, such that the control value for the swivel angle with respect to a predeterminable desired position for the maximum is preset as a reference input value. In an especially advantageous modification, however, the contour of the strip trailing end is evaluated by a polynomial, with which a number of measured values, which in their totality represent the contour of the strip trailing end, are approximated.

The measured values can be determined in digitized form, for example, by a digital camera, and the approximation by the polynomial can be performed in a computer chip connected on the output side. The generation of that polynomial that most closely approximates the determined measured values makes it possible to evaluate the contour of the strip trailing end with a comparatively small number of parameters that must be further processed. Precisely with an evaluation by means of this type of polynomial, the so-called thickness taper component of the strip trailing end contour can also be taken into consideration in an especially advantageous way. The thickness taper is the measure of the deviation of the preferred direction of the contour of the strip trailing end from the width direction of the rolling stock. In this regard, the thickness taper can also be alternatively determined by evaluation of those points at which the strip sides end and pass over the contour of the actual strip trailing end. These points can be evaluated and determined in an especially advantageous way by the use of the polynomial.

In another advantageous modification, in addition to the contour of the strip trailing end, the contour of the strip leading end of the product that has already been rolled, which is determined in the extended plane, is taken into consideration in the presetting of the control values for the roll stands. Due to the relatively smaller material flow in the longitudinal direction of the rolling stock towards the leading end of the strip, the extent of possible errors in the selection of the swivel angle for the roll stands is less than in the case of the contour of the strip trailing end; however, consideration of the contour of the strip leading end is a great help in completing the information that can be evaluated for presetting the control values for the swivel angle.

In an advantageous refinement, in the presetting of the control value or of each control value for the swivel angle of the roll stands, further completion of the information for suitable selection of the swivel angle can be achieved by considering a temperature profile determined in the width direction of the strip and/or the strip profile before and/or after the mill train.

Errors in the strip flow and an incorrectly adjusted swivel angle of a roll stand can affect the rolling results to a variable extent, depending on the thickness of the rolling stock. In an advantageous refinement, to take this factor into account, the thickness of the rolling stock during its passage through a roll stand and/or the strip profile before and/or after the mill train is considered in the presetting of the control value for this roll stand.

Due to the decreasing thickness of the rolling stock during passage through the roll stands, interventions made at a forward roll stand as viewed in the rolling direction can also have effects on the strip flow in the rear roll stands as viewed in the rolling direction. Therefore, in an advantageous refinement, especially when the thickness taper of the strip is used as a reference input value for the adjustment of the swivel angle, a control value preset for a roll stand is considered in presetting a control value for a following or each following roll stand as viewed in the rolling direction. When a control value is preset for the swivel angle of a roll stand, the roll stands following it in the mill train are also swiveled, such that their readjustment is intended to compensate disturbances caused by the swiveling of the relatively more forward roll stand. In this regard, in a further advantageous refinement, the control value preset for a roll stand is taken into consideration in the presetting of the control value for the next roll stand to an extent that is proportional to the anticipated decrease in the thickness of the rolling stock during its passage into this next roll stand.

In order to keep the asymmetric tensile stresses in the roll stand as small as possible during its processing, the control value or each control value for the swivel angle of the given roll stand is advantageously readjusted in such a way that a contour of the strip trailing end develops which is symmetric with respect to the longitudinal center axis of the rolling stock. In this regard, minimization of a deviation of the contour of the strip trailing end from an asymmetric contour by suitable presetting of the control values for the swivel angle of the roll stands can be provided as a design criterion for an automatic control device assigned to the mill train.

A presettable taper shape or thickness taper of the strip in its extended plane or, alternatively, the position of the maximum of the contour of the strip trailing end in the width direction can be provided as a reference input value for an automatic control unit assigned to the mill train. In this regard, the control value or each control value for the swivel angle of the given roll stand is advantageously readjusted in such a way that the contour of the strip trailing end assumes its maximum in the width direction of the strip at a position that can be preset as a set point.

In an especially advantageous refinement, especially great flexibility in the processing of the rolling stock can be achieved by presetting the set point for the position of the maximum in the width direction or the set point for the thickness taper of the strip trailing end in the extended plane as a function of the position of the given roll stand in the mill train. For example, strip-like rolling stock that is already asymmetrically formed in the strip cross-sectional direction can be worked in an especially advantageous way by first adjusting the swivel angle in the front roll stand as viewed in the rolling direction in such a way that the thickness taper of the entering strip-like rolling stock is restored, and the rolling stock is thus brought into a cross-sectional shape that is symmetric with respect to its longitudinal center axis. Of course, this makes it necessary to accept the development of strip lengthening of the rolling stock that is not uniform in the width direction in the front roll stand due to the variable material flow. However, due to the still relatively great thickness of the rolling stock in the front roll stand, this type of nonuniform strip lengthening is possibly tolerable. In the following roll stands as viewed in the rolling direction, a symmetric contour of the strip trailing end in the extended plane can be adjusted. This type of flexible presetting of the set points or reference input values for the automatic control thus allows reliable processing of rolling stock that is initially relatively unsymmetric into a relatively symmetric final rolled product with especially small strip flow errors. Different set points are also provided for the strip leading end, the strip middle section, and the strip trailing end.

Furthermore, in an advantageous modification, to support and/or monitor the rolling process, the strip cross-sectional profiles of the rolling stock entering and exiting the mill train are measured.

The objective of the invention with respect to the mill train of the type specified above is achieved with an automatic control unit that presets a control value for an adjusting unit or for each adjusting unit assigned to a roll stand or an edger, advantageously, a control value for the swivel angle of a roll stand or each roll stand, as a function of the contour, determined in the extended plane, of the strip trailing end of a product that has already been rolled. The automatic control unit is advantageously connected at the output side with adjusting devices for adjusting the swivel angles.

To provide a reliable supply of suitable input parameters for the automatic control unit, it is advantageous for the automatic control unit to be connected on the input side with a number of measuring devices assigned to each roll stand for determining the contour in the extended plane of the strip trailing end and/or the strip leading end of the product that has already been rolled. The measuring devices can be installed, for example, on their assigned roll stand in an elevated position, so that it is possible to determine the contour of the strip trailing end in a top view of the rolling stock.

To determine the contour of the strip trailing end, suitable width sensors can be provided, by which the width of the rolling stock can be determined as a function of a longitudinal coordinate. Each measuring device is preferably designed as an optical device, especially a camera, to allow noncontacting measurement.

In another advantageous modification, to allow consideration of the temperature profile of the rolling stock in presetting the control values for the swivel angles of the roll stands, the automatic control unit is connected on the input side with a temperature measuring instrument for determining the temperature profile of the strip in its width direction and/or with a number of measuring devices for determining the strip cross-sectional profile.

The advantages achieved with the invention consist especially in the fact that, by considering the contour of the strip trailing end of a previously rolled product in its extended plane in presetting the control values for the swivel angles of the roll stands, incorrect adjustments in the swiveling of the roll stands, which have an adverse effect on the rolling process and the rolling result, can be compensated in an especially simple and reliable way. In this regard, the detection of the incorrect adjustments by evaluation of preceding rolling results is provided in the manner of a learning or adaptive system, such that the contour of the strip trailing end, as a direct effect of the material flow in the strip-like rolling stock, allows an especially precise and reliable conclusion to be drawn about possible incorrect settings in the swivel angles of the roll stands. Moreover, the presetting of reference input values for the adjustment of the swivel angles as a function of the position of the given roll stand in the mill train allows especially flexible working of the rolling stock, so that even different types of preformed rolling stock can be worked with reliably high rolling quality.

BRIEF DESCRIPTION OF THE DRAWING

An embodiment of the invention is explained on the basis of a drawing.

The same parts are labeled with the same reference numbers in both figures.

DETAILED DESCRIPTION OF THE INVENTION

Figure 1:
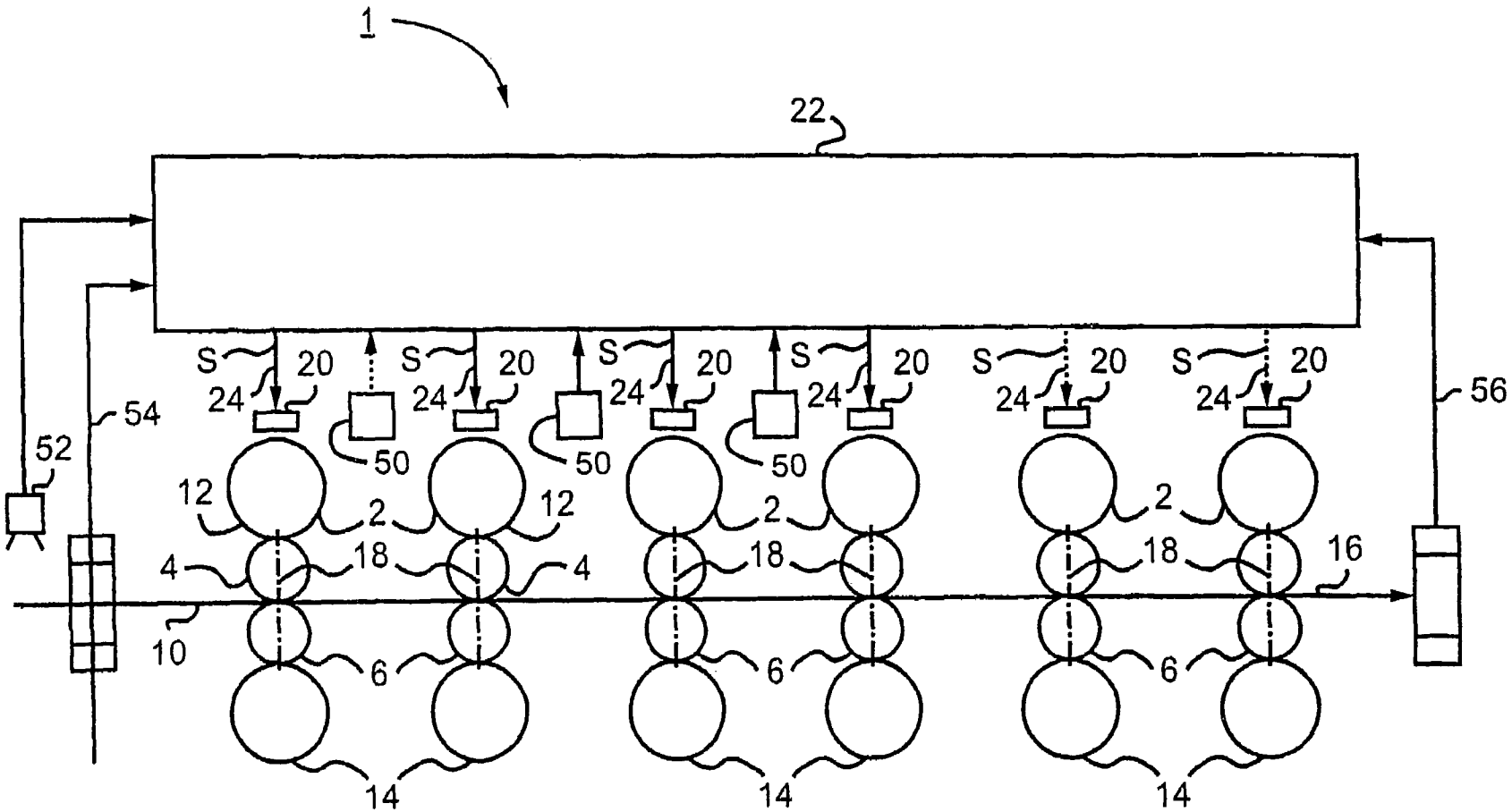
FIG. 1 is a schematic representation of a mill train with a number of roll stands.

The mill train 1 comprises a number of roll stands 2, each of which is designed as a multiple roll stand in the embodiment shown here. To this end, each roll stand 2 comprises a first work roll 4 and a second work roll 6, which together form a roll gap 8 and are designed for rolling stock 10 to pass between them. Each of the work rolls 4, 6 is reinforced by an associated backup roll 12, 14 on its side facing away from the rolling stock 10. The backup rolls in turn are contained in a housing, the details of which are not shown.

The mill train 1 is designed for the working of rolling stock that extends in an extended plane in the form of a strip. The strip-like rolling stock 10 has an essentially two-dimensional shape. Precisely for the working of this type of strip-like rolling stock 10, the so-called strip flow, i.e., the passage of the rolling stock 10 through the roll stands 2, is especially important. Accordingly, the mill train 1 is designed in such a way that the strip flow can be influenced during the actual rolling process. To this end, each roll stand 2 can be adjusted or swiveled about an axis of rotation 18, which is indicated by a line in the drawing and is oriented essentially perpendicularly to the rolling direction "x" indicated by the arrow 16. To adjust the swivel angle., i.e., to adjust a predeterminable orientation of the given roll stand 2 relative to its axis of rotation 18, each roll stand 2 is assigned an adjusting unit 20, which produces an adjustment, the details of which are not shown, of the given roll stand 2.

The mill train 1 has an automatic control unit 22, which is provided, among other reasons, for automated control of the swivel angle of the roll stands 2. To this end, the automatic control unit 22 is connected on the output side with the adjusting device 20 of each roll stand 2 for transmitting a control value S over a data line 24. The mill train 1 and especially its automatic control unit 22 are designed for especially reliable maintenance of an orderly strip flow during the rolling process.

To achieve this purpose, the automatic control unit 22 is designed in such a way that it presets the control values S for the swivel angle of the roll stands 2 as a function of the contour of the strip trailing end 30 determined in the extended plane of a product 10 that has already been rolled. An example of this type of contour of the strip trailing end 30 is shown in top view in FIG. 2 for strip-like rolling stock 10. The drawing shows only a segment of the rolling stock 10 in the region of the strip trailing end 30. The contour of the strip trailing end 30 in the extended plane of the rolling stock 10 may have a relatively irregular shape that is asymmetrical compared to the longitudinal center axis 32 of the rolling stock 10. These types of asymmetries can develop especially as a result of incorrectly adjusted swivel angles in one or more roll stands 2. Specifically, an incorrectly adjusted swivel angle can result in locally different material flow in the longitudinal direction of the strip 10 compared to the rest of the rolling stock 10. This type of locally different material flow is cumulatively reflected in the strip trailing end 30 of the rolling stock 10 in the form of an asymmetric contour.

To preset the control values S for the adjusting units 20 of the roll stands 2, the determination of the maximum of the contour of the strip trailing end 30 in the width direction "y" of the rolling stock 10 can be provided for in the automatic control unit 22. The contour of the strip trailing end 30 can be evaluated as a sequence of points in this case. In this case, the automatic control unit 22 could output the control values S for the swivel angle of the roll stands 2 in such a way that the maximum in the contour of the strip trailing end 30 develops as a symmetric contour in a position in the immediate vicinity of the longitudinal center axis 32 of the rolling stock 10. Alternatively, it would also be possible to evaluate the contour of the strip trailing end 30 by spline functions.

Figure 2:
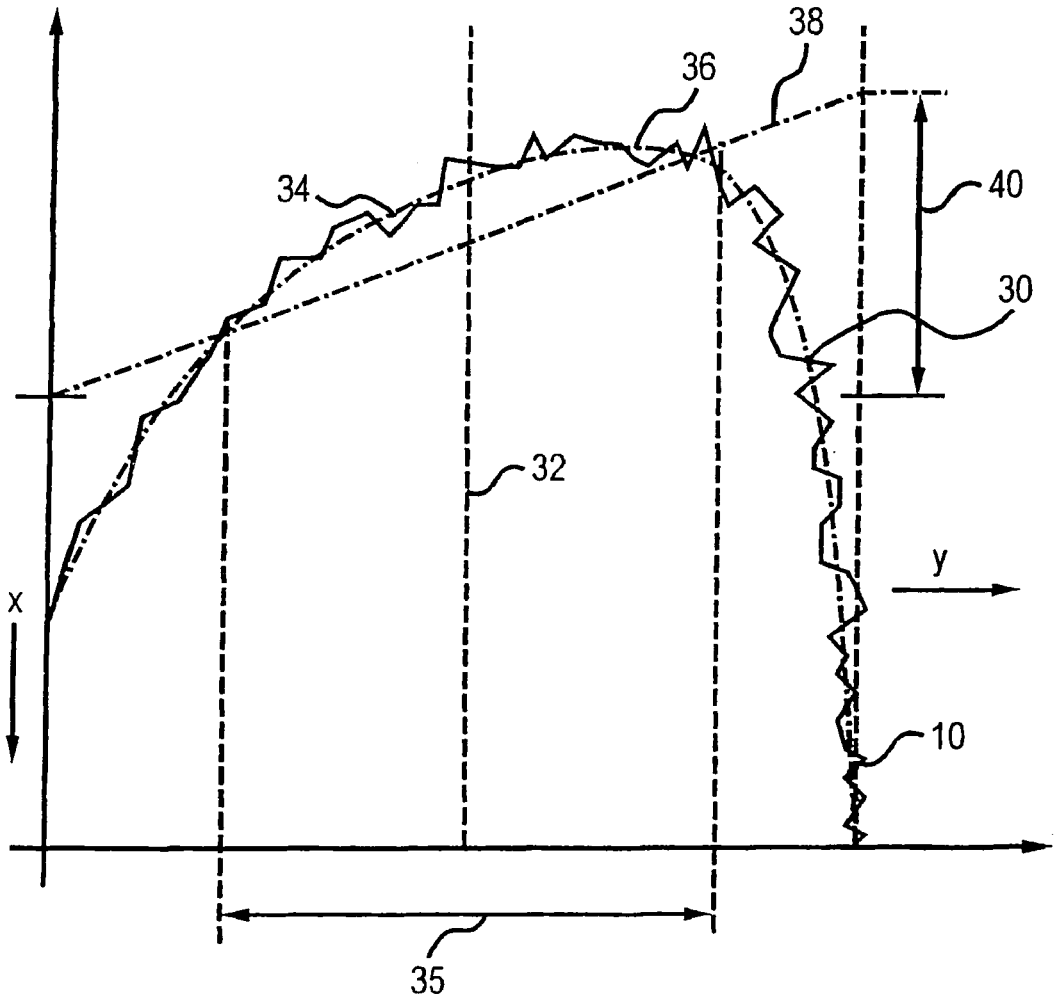
FIG. 2 shows the strip trailing end of rolling stock with a strip-like shape.

However, in the present embodiment, the contour of the strip trailing end 30 is evaluated with the use of a polynomial. In this regard, a polynomial, whose curve 34 is shown in FIG. 2 as a broken line, is selected in such a way that its curve 34 represents the best possible approximation of the actual contour of the strip trailing end 30 determined from a number of measured values. In the mathematical determination of the polynomial, greater weighting of the measuring points in the center region 35 of the strip is advantageous. The further evaluation of the contour of the strip trailing end 30 can be performed with a comparatively small number of parameters with the use of this polynomial.

The position of the maximum 36 in the curve 34 of the polynomial in the width direction "y" of the rolling stock 10 can be used as a reference input value for the predetermination of the control values S by the automatic control unit 22. Alternatively, however, the so-called thickness taper of the strip trailing end 30 can be determined as a reference input value. In this regard, a preferred direction of the strip trailing end 30, which is shown schematically in FIG. 2 by the line 38, is determined by evaluation of the polynomial or of the individual measured values, which reproduce the actual behavior of the contour of the strip trailing end 30. This preferred direction corresponds to a length difference 40 of the outer sides of the rolling stock 10 as seen over the total width of the rolling stock 10. This length difference 40 is thus a measure of the asymmetry of the strip trailing end 30.

To determine the contour of the strip trailing end 30, the mill train 1 is equipped with a number of measuring instruments 50, as is shown in FIG. 1. The measuring instruments 50 may be embodied, for example, as width sensors. In the present embodiment, however, noncontacting optical determination of the contour of the strip trailing end 30 is provided. To this end, the measuring instruments 50 are designed as optical devices, namely, as cameras. The measuring instruments 50 are installed between adjacent roll stands 2 at a level such that it is possible to determine the contour of the strip trailing end 30 in a top view of the rolling stock 10. In this regard, the automatic control unit 22 is connected on the input side to the measuring instruments 50 to receive the measured values that characterize the contour of the strip trailing end 30, which are supplied by the measuring instruments 50.

In the present embodiment, the measuring instruments 50, which are embodied as cameras, are dimensioned and positioned in such a way that the entire contour of the strip trailing end 30, i.e., the contour across the whole width of the rolling stock 10, lies within the measuring range of the given measuring instrument and can thus be simultaneously determined. Alternatively, however, for example, due to deviating outer boundary conditions, e.g., in the case of very long strip slivers, one or each measuring instrument 50 may be positioned in such a way that its measuring range does not cover the entire width of the rolling stock 10. In this case, to determine the contour of the strip trailing end 30 in the form of sequential scanning, the affected measuring instrument 50 takes a series of partially overlapping individual pictures, which in their totality reproduce the complete contour of the strip trailing end 30. These individual pictures are then combined into a total picture in an evaluation unit in such a way that they coincide in the overlapping regions. When the strip trailing end 30 runs in the transverse direction, the individual pictures are also shifted accordingly.

In addition, the automatic control unit 22 is connected on the input side with a temperature-measuring instrument 52. The temperature-measuring instrument 52 is designed to determine a temperature profile of the rolling stock 10 in its width direction "y".

Moreover, the automatic control unit 22 is connected on the input side with a first profile-measuring device 54 and with a second profile-measuring device 56. The profile-measuring device 54 is installed in front of the first roll stand 2 as viewed in the rolling direction of the rolling stock and serves to determine the cross-sectional profile of the rolling stock 10 entering the mill train 1, whereas the profile-measuring device 56 is installed after the last roll stand 2 as viewed in the rolling direction of the rolling stock 10 and serves to determine the cross-sectional profile of the rolling stock 10 exiting the mill train 1.

During the operation of the mill train 10, the swivel angle of each roll stand 2 is adjusted by the presetting of suitable control values S by the automatic control unit 22 for the reliable maintenance of a strip flow that is favorable for a qualitatively high-grade rolling result. In this regard, the mill train 1 is designed as a learning or adaptive system, in which the control values S are predetermined by taking into consideration the rolling result obtained with previously rolled products. To this end, the contour of the strip trailing end 30 of a product 10 that has already been rolled is determined by the measuring instruments 50. In this regard, the contour can be determined for a rolled product 10 that has already completely left the mill train 1 or for rolling stock 10 that has already left one of the roll stands 2 but must still pass through the following roll stands 2.

During the determination of the contour of the strip trailing end 30, the measured values supplied by the measuring instrument 50 are used to generate the polynomial that approximates the contour behavior. For each roll stand 2, this polynomial is used to check whether a reference input value provided for this roll stand 2 lies within the tolerance range of a presettable set point. Examples of reference input values that can be used are the position of the maximum of the polynomial in the width direction "y" of the rolling stock 10 or the length difference 40 that characterizes the thickness taper of the rolling stock 10. In regard to the correspondingly preset reference input value, the control values S for the roll stands 2 are readjusted in such a way that the corresponding set points are more and more closely approximated.

In the present embodiment, the automatic control unit 22 generates correction values ΔS for the swivel angle of the roll stand 2 with consecutive number i within the mill train 1 according to the following equation:

$$\Delta S_i = H_i * \Delta L_i / L_i * f_i * f_u$$

in which the symbols have the following meanings:

$H_i$: the thickness of the rolling stock 10 at a given roll stand 2 with position number i;

$\Delta L_i$: the thickness taper component or the length difference 40 of the rolling stock 10 at the roll stand with position number i;

$L_i$: a reference length, on which, in the rolling stock 10, a material flow occurs in the rolling direction or longitudinal direction of the rolling stock 10; this reference length depends on the position number i of the roll stand 2, $f_i$: a factor for evaluating the material flow in the rolling stock 10 in its longitudinal direction, $f_u$: as a sort of swivel modulus, a conversion factor for converting a strip thickness taper to a control value for the adjustment position.

In this regard, the automatic control unit 22 is additionally designed also to take into consideration a control value for the swivel angle of a given roll stand 2 in presetting the control values for the swivel angles of the following roll stands 2. This is intended to compensate as much as possible the disturbance in the strip flow produced by the swiveling of one roll stand 2 in the roll stands 2 that follow it in the mill train 1. The following roll stands 2 are swiveled to an extent that is proportional to the decreasing thickness of the rolling stock in the rolling direction.

The automatic control unit 22 also presets control values for the bending forces of the work rolls 4, 6, and to this end is connected to adjusting elements (not shown) assigned to each of the work rolls 4, 6. The control values for the bending forces of the work rolls 4, 6 are also readjusted and corrected on the basis of the contour determined for the strip trailing end 30. To accomplish this, the behavior of the strip width in each successive roll stand 2 is calculated in the automatic control unit 22 from the contour determined for the strip trailing end 30, taking into account the lengthening of the strip. The control values for the bending force of the work rolls 4, 6 are predetermined from these width characteristics, taking into account the roll bending behavior, in such a way that unevenness of the rolling stock 10 and thus defective strip rolling develop to the least possible extent.

In addition, the automatic control unit 22 can also be designed to use the contour determined for the strip trailing end 30 to preset a tensile force for a looper and/or to preset a control value for an edger (not shown) installed in front of the mill train 1.

The method can be used not only in a mill train that consists of several stands, but also in reversing mills, in which several passes are rolled.

List of Reference Numbers

| | |
|---|---|
| 1 | mill train |
| 2 | roll stand |
| 4, 6 | work rolls |
| 8 | roll gap |
| 10 | rolling stock |
| 12, 14 | backup rolls |
| 16 | arrow |
| 18 | axis of rotation |
| 20 | adjusting unit |
| 22 | automatic control unit |
| 30 | strip trailing end |
| 32 | longitudinal center axis |
| 34 | curve of the smoothing function (e.g., polynomial) |
| 35 | strip center region |
| 36 | maximum |
| 38 | line |
| 40 | length difference of measure of the strip trailing end thickness taper in the extended plane |
| 50 | measuring instrument |
| 52 | temperature measuring instrument |
| 54, 56 | profile measuring devices |
| S | control value |
| x | rolling direction |
| y | width direction |
| i | position number |

What is claimed is:

1. Method of operating a mill train (1) for rolling strip-like rolling stock (10) with an edger and a number of roll stands (2) arranged one behind the other in a rolling direction (x), comprising using a number of adjusting units (20) to affect a contour trailing end (30) of the strip, presetting a control value (S) for an adjusting unit or for each adjusting unit (20) assigned to a roll stand (2) or an edger as a function of the contour determined for the strip trailing end (30) of a product (10) that has already been rolled, readjusting the control value or each control value (S) in such a way that the contour of the strip trailing end (30) assumes a maximum (36) in the width direction (y) of the strip at a position that can be preset as a set point, further comprising presetting a set point for the position of the maximum (36) in the width direction (y) and/or for the thickness taper of the strip trailing end (30) as a function of the position of the given roll stand (2) in the mill train (1).

2. Method in accordance with claim 1, comprising presetting a control value (S) for a swivel angle of a roll stand or each roll stand (2) about an axis of rotation (18) that is oriented essentially perpendicularly to the rolling direction (x) as a function of the contour determined for the strip trailing end (30) of the product (10) that has already been rolled.

3. Method in accordance with claim 1, wherein the contour of the strip trailing end (30) is optically determined.

4. Method in accordance with claim 1, wherein the control value or each control value (S) is preset on the basis of an evaluation of a polynomial, which approximates a number of measured values, which in their totality characterize the contour of the strip trailing end (30).

5. Method in accordance with claim 1, wherein the contour determined for the strip leading end of the product (10) that has already been rolled is taken into consideration in presetting the control value or each control value (S).

6. Method in accordance with claim 1, wherein a temperature profile of the rolling stock (10) determined in the width direction (y) of the strip and/or a thickness profile determined in the width direction (y) of the strip is taken into consideration in presetting the control value or each control value (S).

7. Method in accordance with claim 1, wherein the thickness of the rolling stock (10) during its passage through a roll stand (2) is taken into consideration in presetting a control value (S) for this roll stand (2).

8. Method in accordance with claim 7, wherein a control value (S) preset for a roll stand (2) is also taken into account in presetting a control value (S) for a roll stand or each roll stand (2) that follows it as viewed in the rolling direction (x).

9. Method in accordance with claim 8, wherein the control value (S) preset for a roll stand (2) is taken into consideration in presetting the control value (S) for the next following roll stand (2) to an extent that is proportional to the intended reduction of the thickness of the rolling stock (10) during its passage into this next roll stand (2).

10. Method in accordance with claim 1, wherein the control value or each control value (S) is readjusted in such a way that a contour of the strip trailing end (30) develops which is symmetric with respect to the longitudinal center axis (32) of the rolling stock (10).

* * * * *